US009592934B2

(12) United States Patent
Painchaud et al.

(10) Patent No.: US 9,592,934 B2
(45) Date of Patent: Mar. 14, 2017

(54) LIQUID DISPENSING DEVICE EQUIPPED WITH A REMOVABLE CAP

(71) Applicant: Nemera La Verpillière S.A.S., La Verpilliere (FR)

(72) Inventors: Gaetan Painchaud, Francheville (FR); Xavier Julia, Villefontaine (FR); Thierry Decock, Lyons (FR); Guillaume Grevin, L'Isle d'Abeau (FR); Benjamin Quaglia, Oyonnax (FR)

(73) Assignee: Nemera La Verpillière S.A.S. (FR)

( * ) Notice: Subject to any disclaimer, the term of this patent is extended or adjusted under 35 U.S.C. 154(b) by 127 days.

(21) Appl. No.: 14/385,451

(22) PCT Filed: Mar. 15, 2013

(86) PCT No.: PCT/FR2013/050545
§ 371 (c)(1),
(2) Date: Sep. 15, 2014

(87) PCT Pub. No.: WO2013/140069
PCT Pub. Date: Sep. 26, 2013

(65) Prior Publication Data

US 2015/0043958 A1 Feb. 12, 2015

(30) Foreign Application Priority Data

Mar. 19, 2012 (FR) ..... 12 52435
Nov. 23, 2012 (FR) ..... 12 61187

(51) Int. Cl.
*B65D 35/36* (2006.01)
*B05B 11/00* (2006.01)
(Continued)

(52) U.S. Cl.
CPC ..... *B65D 35/36* (2013.01); *B05B 11/00* (2013.01); *B05B 11/0032* (2013.01);
(Continued)

(58) Field of Classification Search
CPC . B05B 15/02; B05B 15/0208; B05B 15/0216; B05B 15/0406; B05B 11/0032;
(Continued)

(56) References Cited

U.S. PATENT DOCUMENTS 2,249,832 A * 7/1941 Hubschman ..... B65D 47/18 222/420
2,301,988 A * 11/1942 Wallenmeyer ..... B65D 51/1616 220/231
(Continued)

FOREIGN PATENT DOCUMENTS

EP 0747292 A1 12/1996
EP 0864371 A1 9/1998
(Continued)

OTHER PUBLICATIONS

International Search Report Application No. PCT/FR2013/050545 Completed: Jul. 23, 2013; Mailing Date: Jul. 31, 2013 3 Pages.

*Primary Examiner* — Jennifer C Chiang
*Assistant Examiner* — Bradley Oliver
(74) *Attorney, Agent, or Firm* — St. Onge Steward Johnston & Reens LLC

(57) ABSTRACT

A device for dispensing liquid including an opening for dispensing liquid, a pad for absorbing residual liquid and a removable cap including a shape in the immediate vicinity and opposite the dispensing opening, referred to as a shape for expelling residual liquid, configured to discharge the residual liquid toward the pad when the cap is mounted on the device.

19 Claims, 5 Drawing Sheets

(51) Int. Cl.

| | |
|---|---|
| ***B05B 11/02*** | (2006.01) |
| ***B05B 11/04*** | (2006.01) |
| ***B05B 15/02*** | (2006.01) |
| ***B05B 15/04*** | (2006.01) |
| ***B65D 83/34*** | (2006.01) |
| ***B65D 83/40*** | (2006.01) |
| ***B65D 83/56*** | (2006.01) |
| *B05B 15/00* | (2006.01) |

(52) U.S. Cl.
CPC ..... *B05B 11/02* (2013.01); *B05B 11/04* (2013.01); *B05B 15/0208* (2013.01); *B05B 15/0406* (2013.01); *B65D 83/34* (2013.01); *B65D 83/40* (2013.01); *B65D 83/56* (2013.01); *B05B 11/007* (2013.01); *B05B 11/0072* (2013.01); *B05B 15/008* (2013.01)

(58) Field of Classification Search
CPC ..... B65D 51/1616; B65D 51/1672; B65D 51/1677; B65D 51/1683; B65D 83/34; B65D 83/56
USPC ..... 401/262, 265
See application file for complete search history.

(56) References Cited

U.S. PATENT DOCUMENTS

| | | | | | |
|---|---|---|---|---|---|
| 2,579,202 | A * | 12/1951 | Piccoli | A45D 34/04 | 215/232 |
| 3,072,953 | A * | 1/1963 | Bunke | A45D 40/26 | 401/132 |
| 4,463,880 | A * | 8/1984 | Kramer | B65D 47/42 | 222/189.08 |
| 4,765,499 | A * | 8/1988 | von Reis | B65D 51/1616 | 215/261 |
| 4,936,700 | A * | 6/1990 | Morris | A45D 34/04 | 215/348 |
| 8,281,962 | B2 * | 10/2012 | Ogawa | B65D 47/248 | 215/329 |
| 8,794,490 | B2 | 8/2014 | Painchaud et al. | | |
| 2002/0066752 | A1 * | 6/2002 | Ritsche | B05B 11/0027 | 222/153.13 |
| 2004/0200860 | A1 * | 10/2004 | Buxmann | B05B 11/0032 | 222/321.6 |
| 2006/0043116 | A1 * | 3/2006 | Kawashiro | B65D 47/20 | 222/212 |
| 2006/0180613 | A1 * | 8/2006 | Manesis | A61F 9/0008 | 222/189.09 |
| 2006/0191959 | A1 * | 8/2006 | Davies | B05B 11/0032 | 222/162 |
| 2008/0249459 | A1 * | 10/2008 | Godfrey | A61M 15/009 | 604/19 |
| 2011/0125111 | A1 | 5/2011 | Chibret et al. | | |
| 2013/0134186 | A1 | 5/2013 | Defemme et al. | | |
| 2013/0200099 | A1 | 8/2013 | Abe | | |
| 2015/0166229 | A1 * | 6/2015 | Wochele | B65D 41/48 | 222/153.05 |
| 2016/0311588 | A1 * | 10/2016 | Wochele | B65D 47/18 | |

FOREIGN PATENT DOCUMENTS

| | | | |
|---|---|---|---|
| EP | 1466668 | A1 | 10/2004 |
| EP | 1541487 | A1 | 6/2005 |
| EP | 1661818 | A1 | 5/2006 |
| FR | 2896775 | A1 | 8/2007 |
| FR | 2937018 | A1 | 4/2010 |
| JP | H03178671 | A | 8/1991 |
| JP | H07507221 | A | 8/1995 |
| JP | H09150855 | A | 6/1997 |
| WO | 2010013131 | A1 | 2/2010 |
| WO | 2011099309 | A1 | 8/2011 |
| WO | 2012014050 | A2 | 2/2012 |

* cited by examiner

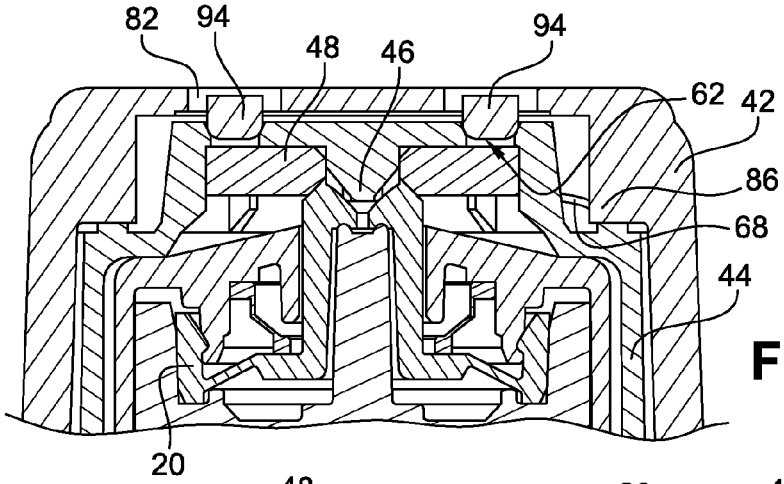
Fig. 7
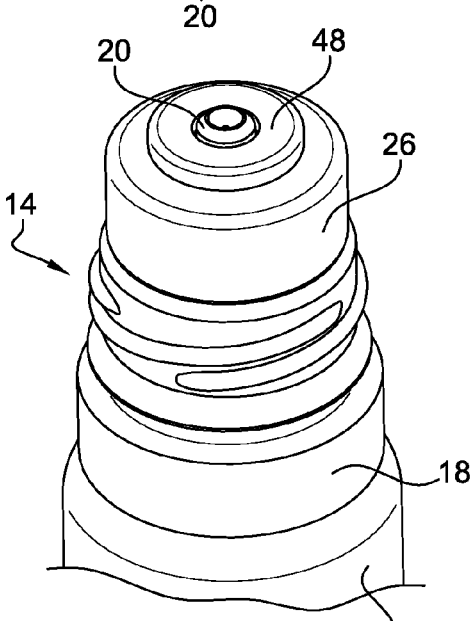
Fig. 8
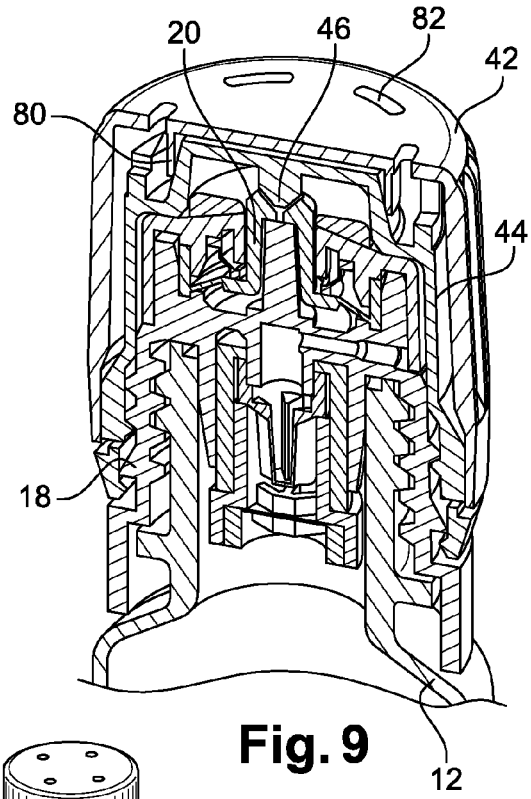
Fig. 9
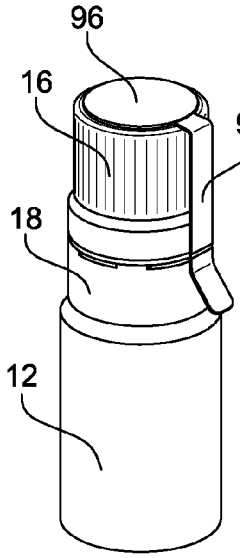
Fig. 10
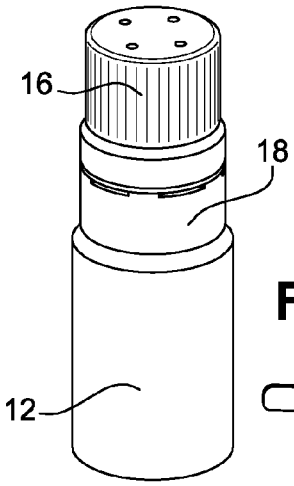
Fig. 11
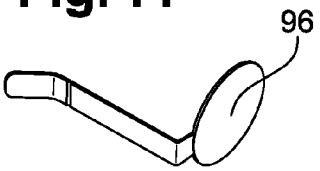

LIQUID DISPENSING DEVICE EQUIPPED WITH A REMOVABLE CAP

FIELD OF THE INVENTION

The present invention relates to the technical field of liquid dispensing. In particular, but not exclusively, it relates to the field of the dispensing of liquid in droplet form or in spray form, such as ophthalmic, nasal, buccal or auricular liquid

BACKGROUND OF THE INVENTION

A liquid dispensing device is known from the document FR 2 937 018 that comprises a container and a dispensing end piece. This end piece comprises a liquid dispensing opening.

However, when the liquid is being delivered, a little amount of liquid can stagnate in the vicinity of the liquid dispensing opening.

When a certain time elapses between two uses of the device, the residual liquid located close to the dispensing opening can evaporate. The concentration of the active principle contained in the residual liquid is therefore greater and the active principle can ultimately be deposited close to the opening, forming a precipitate. The next time the device is used, the quantity of active principle delivered is therefore increased by this precipitate which is carried by the delivery of the next droplet. The active principle dose delivered is therefore greater than the prescribed dose. There is also a risk of administrating solid particles which have not dissolved in the next droplet delivered.

Furthermore, the residual liquid located close to the outlet orifice can be contaminated by bacteria which can contaminate the next droplet delivered. There is therefore also a risk of microbial contamination of the liquid delivered.

In particular, the present invention proposes to provide a liquid dispensing device that makes it possible to deliver a more accurate product dose.

SUMMARY OF THE INVENTION

To this end, the object of the invention is a liquid dispensing device, comprising:

- a liquid dispensing opening,
- an absorption pad for absorbing residual liquid, arranged in proximity to the liquid dispensing opening, and
- a removable cap comprising a shape, in the immediate vicinity of and facing the liquid dispensing opening, called expulsion shape of the residual liquid, configured to discharge the residual liquid toward the pad when the cap is fitted on the device.

By virtue of the presence of the expulsion shape of the residual liquid on the removable cap, when the cap is fitted on the device, the expulsion shape situated in the immediate vicinity and facing the liquid dispensing opening expels most of the residual liquid present downstream of the dispensing opening, especially toward the pad for absorbing residual liquid arranged in proximity, that is to say that the residual liquid is discharged toward the absorption pad. It will therefore be understood that the pad is arranged downstream of the dispensing opening. Most of the residual liquid is thus drained out of the dispensing opening.

It will be understood that, since the volume of the residual liquid present downstream of the dispensing opening is generally small, it is advantageous for the expulsion shape to be able to be positioned sufficiently close to and facing the dispensing opening when the cap is fitted on the device and to thus be able to expel this small quantity of liquid out of the liquid dispensing opening.

The expulsion or discharging of residual liquid in the vicinity of the dispensing opening avoids the development of bacteria in this area, which is particularly advantageous when the liquid dispensed does not include any preservative.

By virtue of this discharge, the dose of active principle delivered is thus more reproducible and more accurate, since the pad avoids the accumulation of liquid close to the dispensing opening of the device.

Furthermore, the risk of delivering subsequent more concentrated doses or solid particles is thus greatly reduced. Indeed, upon the evaporation of the residual liquid downstream of the dispensing opening, deposits due to the precipitation of the active principle may be formed. These deposits may be partially dissolved upon the delivery of the next product dose and thus increase the quantity of active principle delivered and/or remain in the form of particles.

Finally, because the risk of the formation of solid or viscous deposits close to the dispensing opening is reduced, the esthetic effect of the device is also enhanced.

Advantageously, the expulsion shape is made in one piece with the cap and of the same material as the cap, generally obtained by molding.

The terms upstream and downstream should be interpreted with the direction of dispensing of the liquid taken as reference direction.

The invention can further comprise one or more of the following features, taken alone or in combination.

The expulsion shape is a shape substantially complementing the dispensing opening. It delimits, preferably with the liquid dispensing opening, a pathway for the discharge of the residual liquid.

The expulsion shape is made of a non-absorbent material. The residual liquid cannot be absorbed by this shape and the expulsion of the residual liquid from the dispensing opening to the pad is more effective.

The device comprises a path for the evaporation of the residual liquid between the pad and the outside of the device when the cap is fitted on the device. The evaporation of the residual liquid absorbed by the pad is thus promoted. This evaporation path can, for example, comprise air passage orifices in the cap, these orifices being borne preferentially by a top face of the cap.

The device can take, when the cap is fitted on the device, a configuration of hermetic sealing of the device, prior to its first use, wherein the path for the evaporation of the residual liquid is blocked between the pad and the outside of the device, and a configuration of ventilation of the device, wherein the evaporation path is open between the pad and the outside. Thus, the evaporation of the liquid contained in the device can be limited when the device is stored prior to its first use. Indeed, the devices filled with liquid to be dispensed can be stored for several months, even several years, before their first use. During this storage, a diffusion of the liquid can occur, notably through the walls of some of the elements of the device, such as a valve for example. If the evaporation path is open, there is permanent discharge of this liquid to the outside of the device. On the other hand, when the evaporation path is closed, a balance is achieved, the diffusion of the liquid through the cap being less than the diffusion of the liquid through the valve, for example. According to a particular embodiment, the path is blocked by a removable cover, preferably disposable, added to the cap. This embodiment is simple and effective. It will be noted that, according to an alternative, a cover is added upstream of the path for the evaporation of the residual liquid, for example by adding it directly onto the dispensing opening or onto a valve arranged in proximity to this opening. According to another embodiment, the device can switch from the hermetic sealing configuration to the ventilation configuration by the displacement of at least a part of the cap relative to a container on which the device is mounted.

The device comprises means for locking the device in the ventilation configuration. These means are preferably non-removable, that is to say permanent. It is therefore possible to switch from the hermetic sealing configuration, which corresponds to a configuration of storage of the device, to the ventilation configuration, which corresponds to a configuration of use of the device, but it is not possible to switch from the ventilation configuration to the hermetic sealing configuration. There is thus a guarantee that, after the first use of the device, the path for the evaporation of the residual liquid remains open between the pad and the outside of the device.

The cap comprises an outer jacket and an inner jacket, mounted to move relative to one another between a first configuration corresponding to the configuration of hermetic sealing of the device and a second configuration corresponding to the configuration of ventilation of the device. For example, the outer jacket and the inner jacket can move in rotation relative to one another, this rotational movement preferably generating a translational longitudinal displacement of one relative to the other. Longitudinal direction should be understood to mean the axial direction of the device, generally corresponding to the axis of the container. It will be noted that, preferably, the two jackets are coaxial, their respective axes being merged with the axis of the device.

The outer jacket and the inner jacket of the cap each comprise air passage orifices and the cap comprises means for blocking, when the device is in the hermetic sealing configuration, the evaporation path between the orifices of the outer jacket and those of the inner jacket. The blocking means comprise, for example, a crown ring borne by the outer jacket and cooperating by clamping with a tapered surface of the inner jacket of the cap, or vice versa. According to another example, the blocking means comprise pins borne by the outer jacket and cooperating by clamping with orifices of the inner jacket of the cap, or vice versa.

The inner jacket comprises a ramp cooperating with a complementary abutment borne by the outer jacket, or conversely, such that the rotation of the outer jacket relative to the inner jacket generates a longitudinal displacement of one relative to the other. In this rotation and longitudinal displacement, the device switches from the hermetic sealing configuration to the ventilation configuration: the evaporation path is therefore open between the pad and the outside of the device. Thus, the switch from one configuration to the other is made transparently for the user, who, when he or she unscrews the cap to use the device for the first time, first makes the device switch from the hermetic sealing configuration to the ventilation configuration before fully unscrewing the cap.

The outer jacket and the inner jacket comprise longitudinal retaining abutments of the outer jacket on the inner jacket. The abutments allow for a limited longitudinal displacement of the outer jacket relative to the inner jacket so that, by virtue of the retaining abutments, the two jackets cannot be separated from one another. It will therefore be understood that the two jackets can be displaced relative to one another longitudinally by a predetermined distance, but cannot be separated from one another.

The absorption pad comprises one or more hydrophilic materials, making it possible to drain the liquid, that is to say capable of absorbing liquid, even of allowing it to evaporate if an evaporation path is open. The material of the pad can comprise woven or non-woven materials. It can, for example, comprise a hydrophilic cotton, polyethylene (PE) having undergone a hydrophilic treatment, polyethylene terephthalate (PET) having undergone a hydrophilic treatment, a poly(vinyl acetate) foam (PVA) or a mixture of several hydrophilic materials.

The absorption pad comprises a hydrophilic material with open porosity. Material with open porosity should be understood to mean a material comprising a network of continuous channels defined by pores communicating with one another, which enable the liquid absorbed in the pad to be drained from the dispensing opening toward the outside of the device. Thus, the liquid can migrate from one face of the pad to the other and evaporate toward the outside of the device.

The absorption pad comprises at least two distinct absorbent materials, the at least two materials being arranged one on top of the other and the downstream material being more hydrophilic than the upstream material. Thus the liquid is sucked in by the more hydrophilic material and the residual liquid does not stagnate in the less hydrophilic material arranged in proximity to the dispensing opening.

The upstream material comprises a hydrophobic material. It therefore prevents the liquid absorbed by the more hydrophilic material from returning toward the dispensing opening.

The pad is fixed onto the cap, more specifically inside the cap, around the expulsion shape.

The expulsion shape comprises an absorbent material. Most of the residual liquid present downstream of the dispensing opening is expelled toward the absorption pad arranged in proximity, that is to say that it is possible to discharge the residual liquid toward the absorption pad by draining of the residual liquid through the expulsion shape. A draining of most of the residual liquid out of the dispensing opening is thus obtained.

The device comprises a hydrophobic veil with open porosity, the veil being added onto the pad and the expulsion shape. The liquid absorbed by the most hydrophilic material cannot therefore return toward the dispensing opening.

The pad comprises a hydrophilic material, this material being more hydrophilic than the absorbent material of the expulsion shape. Thus, the liquid drained by the expulsion shape is sucked in by the material of the pad which is more hydrophilic and therefore more absorbent than the material of the expulsion shape. The residual liquid does not therefore stagnate in the expulsion shape.

The material of the expulsion shape comprises a hydrophobic material. It therefore prevents the liquid absorbed by the pad from returning toward the dispensing opening.

The expulsion shape is made in one piece with the pad and of the same material as the pad. The pad and the expulsion shape can, for example, be made of a material comprising an absorption gradient, the part forming the expulsion shape being less absorbent than the part forming the pad.

The pad comprises a surface for contact with the ambient air, the surface exhibiting at least one relief to increase the surface for contact with the ambient air. It is possible, for example, to provide a recess in the pad so that, for given overall dimensions, the surface area of the pad in contact with the ambient air is increased, which facilitates the evaporation of the liquid contained in the pad.

The pad is fixed onto a dispensing end piece. The dispensing end piece is preferably an assembly added onto the container, especially comprising a top jacket arranged around the liquid dispensing opening; the pad is fixed onto this top jacket, around the dispensing opening.

The pad is of substantially axisymmetrical shape. It adapts easily to the cap, in proximity to the residual liquid expulsion shape, or around the end piece.

The device is a device for dispensing liquid in droplet form, comprising droplet forming means, the expulsion shape substantially complementing these droplet forming means. The droplet forming means are preferably substantially tapered, diverging toward the outside of the device. This embodiment is particularly advantageous because the expulsion shape makes it possible to reduce the dead volume formed by the droplet forming means while delimiting, with the droplet forming means, at least partially, a pathway for the evacuation of the residual liquid. Thus, the dose of the droplets dispensed has a volume and a concentration that are more reproducible.

The device comprises a valve that can take a liquid releasing position and a liquid blocking position, the expulsion shape constituting a shape for immobilizing the valve in the liquid blocking position when the cap is fitted onto the device. Thus, it is not possible for liquid that has passed through the valve to be able to return into the device. Furthermore, when the cap is fitted on the device, it is not possible to dispense liquid inadvertently, the valve being blocked in the liquid blocking position. It is particularly advantageous to use the pad in combination with a valve immobilization shape, because the liquid stagnating downstream of the valve can be discharged, and therefore contaminations of the subsequent doses avoided.

The pad is not in contact with the valve. There is therefore little liquid in contact with the valve in the case where the pad contains liquid.

The pad and/or the complementary shape comprises an antimicrobial agent. The antimicrobial agent makes it possible to destroy some of the microorganisms that could develop downstream of the dispensing opening and contaminate the next product dose to be delivered. The antimicrobial agent can, for example, be based on silver or contain a disinfectant product or a biocidal agent.

The most hydrophilic material comprises an antimicrobial agent and the least hydrophilic material is without any antimicrobial agent. Thus, the liquid is sucked toward the most hydrophilic material where antimicrobial agents prevent the development of bacteria. The risk that antimicrobial agents may be contained with the next droplet of liquid delivered by the device is reduced because the antibacterial agent is not contained in the least hydrophilic material which is closest to the droplet forming means.

BRIEF DESCRIPTION OF THE DRAWINGS

The invention will be better understood on reading the following description, given solely by way of example, and with reference to the drawings in which:

FIG. 7 is a cross-sectional view of a second embodiment of the device;

FIG. 8 is a perspective view of a third embodiment of the device;

FIG. 9 is a cross-sectional and perspective view of the device of FIG. 8;

FIG. 10 is a perspective view of a fourth embodiment of the device in hermetic sealing configuration;

FIG. 11 is a perspective view of the device of FIG. 10 in ventilation configuration;

DETAILED DESCRIPTION OF THE INVENTION

Figure 2:
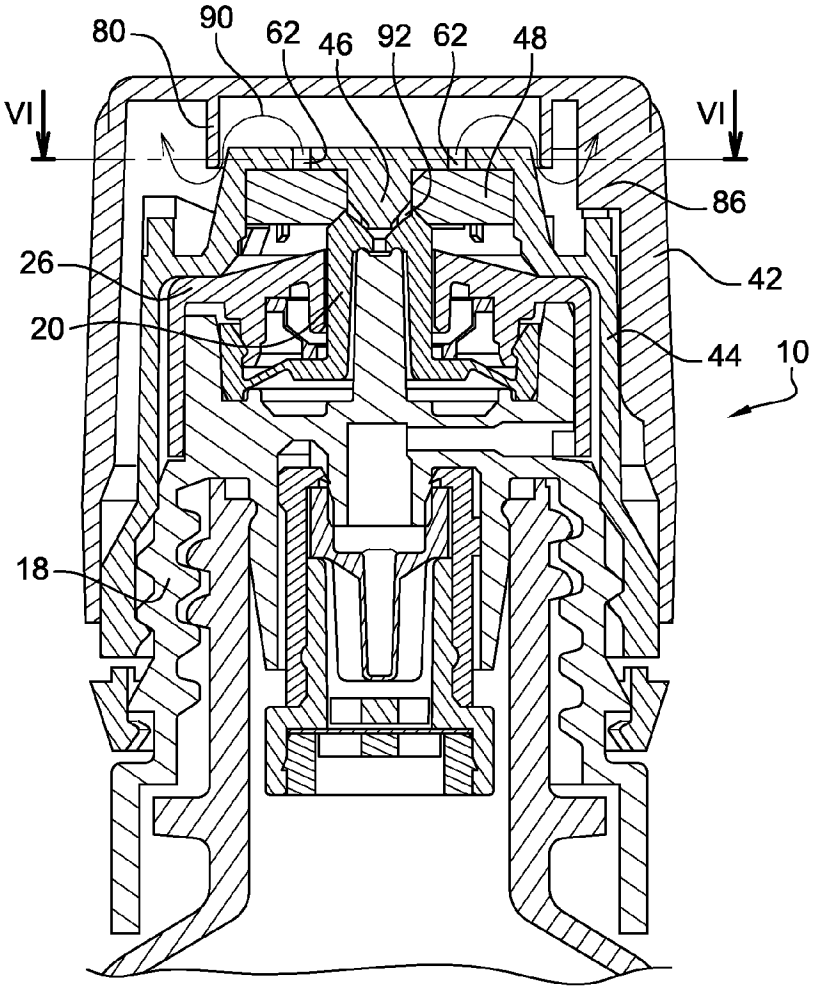
FIG. 2 is a cross-sectional view of the device of FIG. 1 in ventilation configuration.
Figure 1:
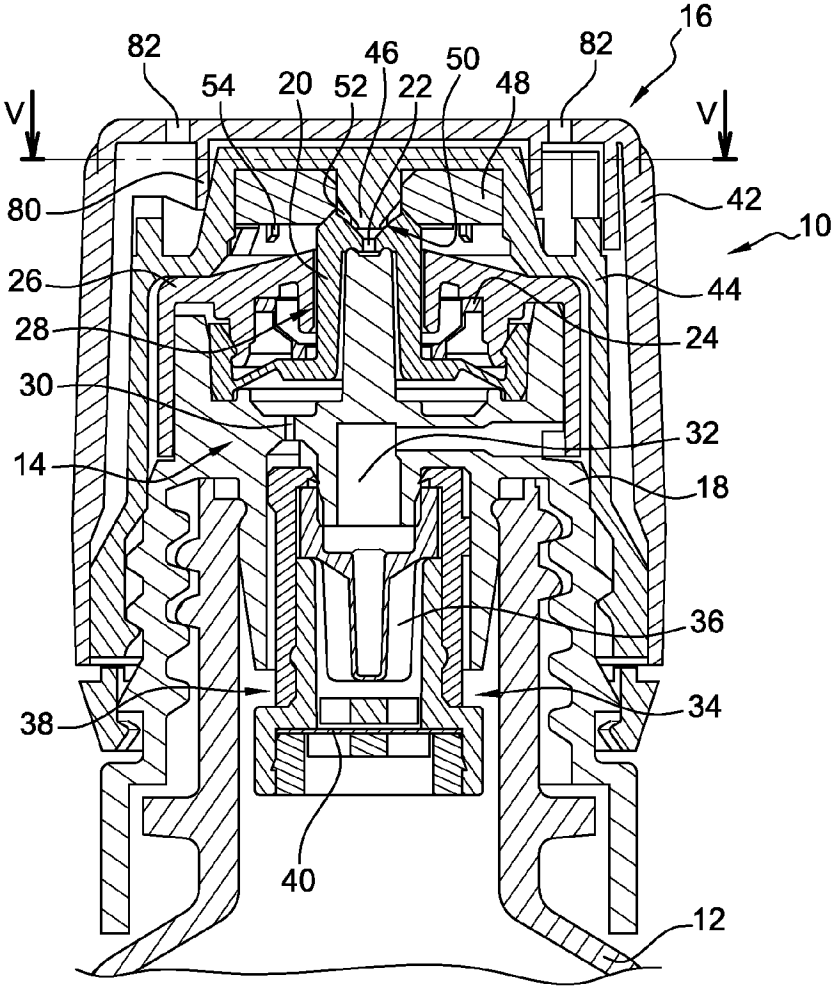
FIG. 1 is a cross-sectional view of a device in hermetic sealing configuration according to a first embodiment of the device.

FIGS. 1 and 2 show a first embodiment of a liquid dispensing device 10, respectively in hermetic sealing configuration and in ventilation configuration. In this nonlimiting example, the device 10 is a device for dispensing liquid in droplet form.

The device 10 comprises a deformable container 12 and a dispensing end piece 14 capped with a removable cap 16. The end piece 14, provided with the cap 16, is intended to be screw-fitted on the neck of a container 12. This container 12 is a liquid storage container, for example storing pharmaceutical liquids such as ophthalmic liquid. The container 12 is deformable, so as to dispense liquid by pressing on the container. More specifically, the liquid is dispensed by pressure, on the part of a user, on the body of the container 12, the latter being able to exhibit a certain elasticity to resume its initial shape after the pressure exerted by the user, which generates a depression inside the container 12.

The end piece 14 and the cap 16 advantageously form an assembly that can be added in one step onto the neck of the container 12.

In this embodiment, the dispensing end piece 14 comprises a support 18, a dispensing valve 20 and means 24 for returning the valve 20 against the support 18 into a liquid blocking position, the means here consisting of an elastic washer 24, made of plastic material. The valve 20 comprises a dispensing opening including a dispensing orifice or opening 22 and droplet forming means 50. The valve 20 can also take a liquid releasing position. Thus, in this example, the liquid dispensing orifice 22 is borne by the valve 20.

The end piece 14 also comprises a top jacket 26, comprising an orifice 28 passed through by the valve 20, a channel 30 for the passage of the liquid from the container 12 to the dispensing orifice 22, and a channel 32 for the passage of air into the container 12, the channel 32 being blocked by an assembly 34 comprising an air diffusion member 36 arranged in an insulating jacket 38 of the diffusion member 36. It will be noted that the air passage channel 32 is entirely molded in the support 18.

The jacket 38 comprises a number of elements making it possible to guarantee the insulation from the liquid contained in the container 12 of the air-permeable member 36. This jacket 38 notably comprises a hydrophobic filter 40, the function of which is to prevent the liquid contained in the container 12 from coming into contact with the member 36. Any sorption of molecules of the active principle on the air diffusion member 36 is thus avoided.

It will be understood that this member 36 makes it possible to compensate the depression generated by the delivery of a droplet of liquid by the user by enabling the molecules of air to pass, by diffusion, through the dense material of this air diffusion member 36, the bacteria or dust not being able to pass through the air diffusion member 36. There is therefore a member allowing for the passage of uncontaminated air from the outside to the inside of the container 12 and that does not exhibit any clogging problems.

Furthermore, the outer annular wall of this insulating jacket 38 can comprise grooves delimiting, with the support 18, at least one liquid passage channel which also provides a flow rate limiting function.

There now follows a description of the cap 16, screw-mounted on the dispensing end piece 14.

This cap 16 comprises an outer jacket 42 and an inner jacket 44. These jackets 42, 44 are coaxial, securely attached to one another by being mounted to move relative to one another in rotation and in longitudinal translation, between the hermetic sealing configuration of the device, that can be seen in FIG. 1, and the ventilation configuration of the device 10, that can be seen in FIG. 2. The inner jacket 44 further comprises a residual liquid expulsion shape 46. This expulsion shape 46 is situated in the immediate vicinity of and facing the dispensing opening.

The expulsion shape 46 is also, in this example, a shape for immobilizing the valve 20 in the liquid blocking position when the cap 16 is mounted on the device 10. For example, the expulsion shape 46 is a pin whose general shape complements the droplet forming means 50, produced in the valve 20, for example the shape 46 is tapered. Thus, the shape 46 ensures that the valve 20 is immobilized by the pinching of the latter against the support 18.

In the embodiment of FIGS. 1 to 5, the cap 16 comprises a residual liquid absorption pad 48, fixed onto the cap 16 and more particularly onto the inner jacket 44. The pad 48 is substantially annular and is arranged around the residual liquid expulsion shape 46.

The section of the ring of the pad 48 is substantially rectangular. One of the corners of the inner face of the pad 48 is beveled and complements the shape of the valve 20. Advantageously, both corners of the inner face are beveled, so that the pad 48 can therefore be fixed onto the inner jacket 44 of the cap interchangeably in one direction or in the other. The inner jacket 44 also comprises abutments 54 for fixing the pad 48 onto the inner jacket 44.

Advantageously, the pad 48 may not be in contact with the valve in order to avoid contacts between the residual liquid present in the pad and the valve 20 when the cap 16 is mounted on the device 10.

The absorption pad 48 advantageously comprises a hydrophilic material, with open porosity.

Furthermore, when the cap 16 is mounted on the device 10, the expulsion shape 46 delimits, at least partially, in this case with the droplet forming means 50 of the valve 20, an evacuation pathway 52, to the pad 48, for residual liquid downstream of the valve 20. In this example, the evacuation pathway 52 is produced by a groove 92, or recess, produced in the shape 46. More specifically, the shape 46 comprises a number of channels, for example four, evenly distributed over the end of the pin 46, delimited on the one hand by the grooves 92 and on the other hand by the droplet forming means 50, these channels being produced when the cap 16 is mounted on the device, the shape 46 then bearing against the valve 20.

Figure 4:
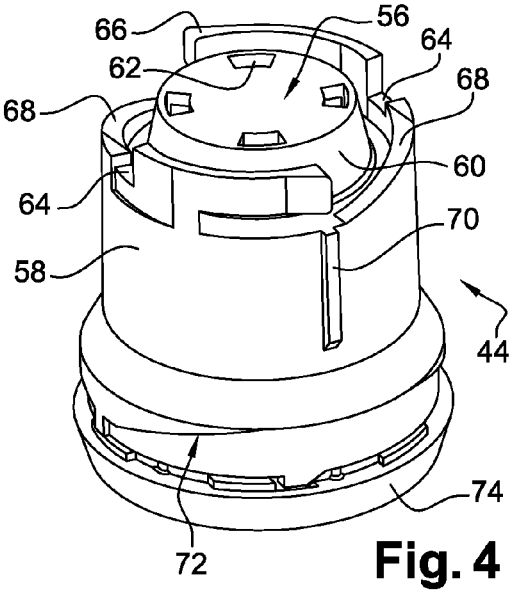
FIG. 4 is a perspective view of an inner jacket of the cap of the device of FIG. 1.

FIG. 4 shows the inner jacket 44, comprising a bottom 56, bearing the expulsion shape 46 at the center of its inner surface, and a skirt 58, substantially cylindrical. The bottom 56 is delimited by a tapered surface 60 and comprises, on its horizontal wall, air passage orifices 62, four of them in this example.

The inner jacket 44 further comprises means 64, 66, 68 for locking the device 10 in the ventilation configuration. These locking means comprise, in this embodiment, notches 64, elastic tabs 66, and ramps 68, in this case two notches 64, two tabs 66 and two ramps 68. The cylindrical skirt 58 comprises abutments 70, in this case two, extending in a longitudinal plane so as to form an abutment in the transverse direction for the outer jacket 42, and thus allow for the screwing of the cap 16 onto the dispensing end piece 14. The cylindrical skirt 58 also comprises abutments 72, called longitudinal retaining abutments, so as to form an abutment in the longitudinal direction, for the retention of the outer jacket 42 on the inner jacket 44 in the longitudinal direction. In FIG. 4, the longitudinal retaining abutments 72 extend mainly in an oblique transverse plane and also comprise a horizontal part. Furthermore, the cylindrical skirt 58 bears, on its free end, a frangible ring 74 of the device 10, a first opening telltale, making it possible to ensure that the device has not been used before its first use.

Figure 3:
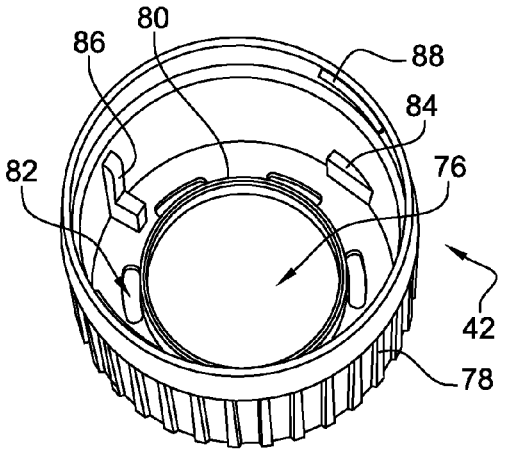
FIG. 3 is a perspective view of the inside of an outer jacket of a cap of the device of FIG. 1.

FIG. 3 shows the outer jacket 42 which comprises a bottom 76 and a skirt 78, substantially cylindrical. The bottom 76 is of circular shape and substantially planer. It comprises a crown ring 80, protruding from the inner surface, and air passage orifices 82 situated on the outside of the crown ring 80. It also comprises means 84, 86 for locking the device 10 in the ventilation configuration, which, in this embodiment, comprise two notches 84 and two screwing abutments 86. The outer jacket 42 further comprises abutments 88, called longitudinal retaining abutments, extending in a transverse plane, so as to form an abutment in the longitudinal direction for the retention of the outer jacket 42 on the inner jacket 44 in the longitudinal direction.

FIG. 2 represents the device 10 in the ventilation configuration, in which a residual liquid evaporation path, represented by the arrow 90, is open between the pad 48 and the exterior of the device 10.

There now follows a description of the mounting of the device 10 and its operation.

The first step is to fit the various constituent elements of the dispensing end piece 14 together. It may be possible, for example, to begin by assembling the air filtration subassembly formed by the jacket 38 and the air diffusion member 36. This subassembly is then mounted on the support 18 by mechanical clamping. The valve 20, the washer 24 and the top jacket 26 are then positioned.

Separately, the pad 48 is fixed inside the inner jacket 44, around the expulsion shape 46 of the valve, by immobilizing it using the fixing abutments 54.

Figure 5A:
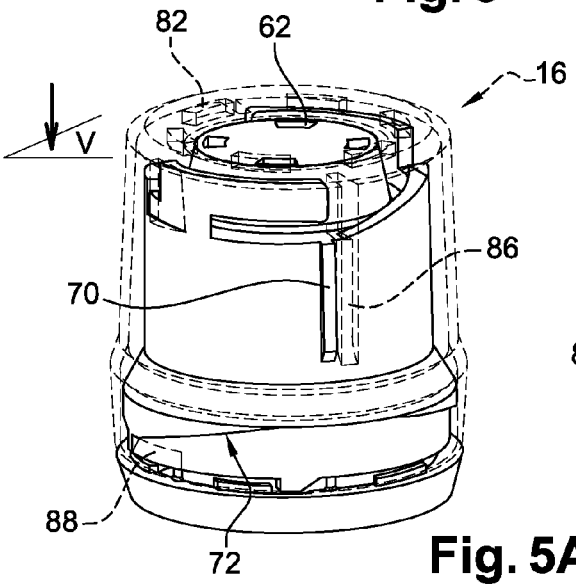
FIG. 5A is a perspective and partially transparent view of the cap of the device of FIG. 1 in hermetic sealing configuration.
Figure 5B:
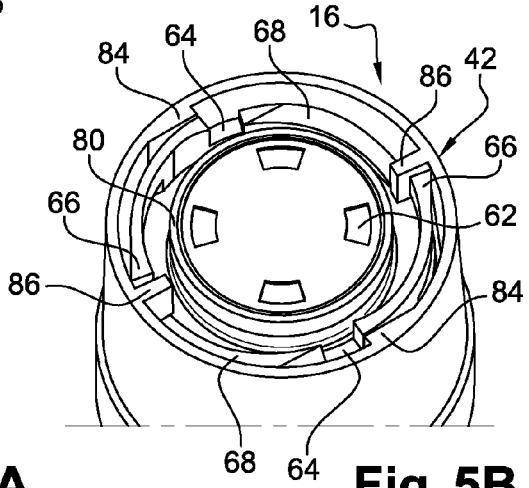
FIG. 5B is a transverse cross-sectional view of the device of FIG. 1, along a plane V shown in FIGS. 1 and 5A.

The outer jacket 42 is then mounted on the inner jacket 44 by positioning the screwing abutments 70 of the inner jacket 44 along the screwing abutments 86 of the outer jacket 42, such that the abutments 86 are positioned facing the bottom of the ramps 68, and the longitudinal retaining abutments 72 of the inner jacket 44 cooperate with the longitudinal retaining abutments 88 of the outer jacket 42, as can be seen in FIGS. 5A and 5B. The outer jacket 42 can no longer be separated from the inner jacket 44. In this embodiment, the cap 16 is ready to be screw-mounted on the dispensing end piece 14.

Once the container 12 is filled with the liquid to be dispensed, the assembly formed by the end piece 14 and the cap 16 is screwed onto the neck of the container. The device 10 is ready to be used.

This first configuration, called storage or hermetic sealing configuration of the device 10, is represented in FIGS. 1, 5A and 5B. FIG. 5A shows the outer jacket 42 in outline mode in order to show the interaction between the elements of the inner jacket 44 with the elements of the outer jacket 42.

In these figures, the crown ring 80 of the outer jacket 42 cooperates with the tapered surface 60 of the inner jacket 44, so that there is no possible communication between the pad 48 and the outside of the device 10, as can be seen in FIG. 1. In the present case, there is no communication between the air passage orifices 62 of the inner jacket 44 and the air passage orifices 82 of the outer jacket 42; the crown ring 80 therefore forms, with the surface 60, a means of blocking the evaporation path 90. The crown ring 80 is slightly deformed and a seal-tightness by mechanical clamping of the crown ring 80 on the tapered surface 60 is produced. The evaporation path 90 of the residual liquid is therefore blocked. Thus, when the device 10 is stored prior to first use, although a small evaporation of the liquid contained in the container 12 can occur, this evaporation is limited.

Furthermore, this evaporation is also limited by the mechanical clamping between the inner jacket 44 and the support 18 which define a sealed volume in which there is no renewal of air as long as the device is in the storage configuration.

Furthermore, this evaporation is also limited because the air diffusion member 36 allows practically no liquid molecules to pass, even in the form of vapor, to this sealed volume.

It will be noted that the expulsion shape 46 of the inner jacket 44 cooperates with the valve 20, more particularly with the droplet forming means 50, and thus blocks the valve 20 in the liquid blocking position.

Upon first use, the user unscrews the removable cap 16. He or she grips the outer jacket 42 in one hand and the container 12 in the other hand. He or she rotates the outer jacket 42 relative to the inner jacket 44. The abutments 86 are then guided by the ramps 68 and the rotational movement imparted by the user on the device 10 generates a longitudinal translational movement of the outer jacket 42 relative to the inner jacket 44. Having arrived at the end of the ramps 68, the abutments 86 cooperate with the notches 64 to form first means for locking the device 10 in the ventilation configuration. Furthermore, during this rotation, the notches 84 of the outer jacket 42 are displaced relative to the elastic tabs 66, that they pass under force, at the end of rotation, by deformation of the tabs 66, such that the notches 84 are abutting against the end of the tabs 66. The notches 84 and the tabs 66 thus form second means for locking the device 10 in ventilation configuration.

Figure 6A:
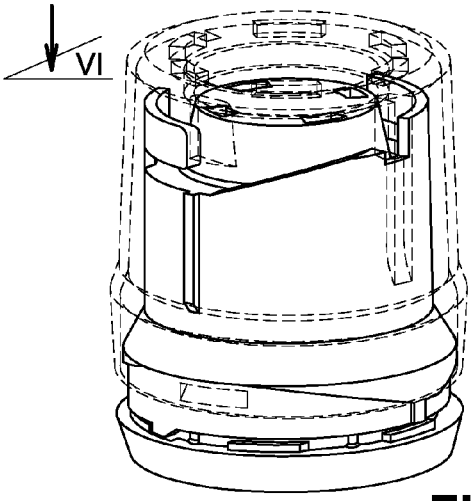
FIG. 6A is a perspective and partially transparent view of the cap of the device of FIG. 1 in ventilation configuration.
Figure 6B:
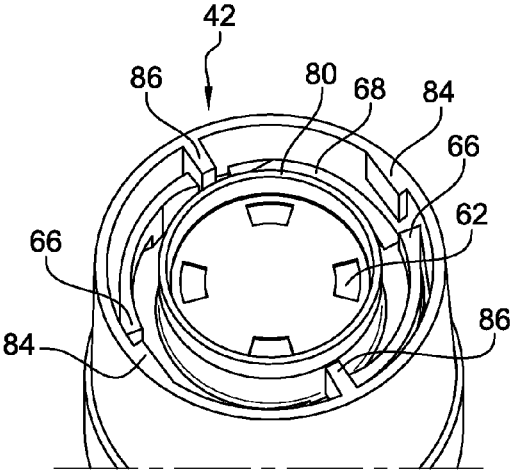
FIG. 6B is a transverse cross-sectional view of the device of FIG. 1, along a plane VI shown in FIGS. 2 and 6A.

In this ventilation configuration, shown in FIGS. 2, 6A and 6B, by virtue of the longitudinal displacement of the outer jacket 42 relative to the inner jacket 44, the crown ring 80 of the outer jacket 42 no longer cooperates with the tapered surface 60 of the inner jacket 44, so that a space is created between the crown ring 80 and the surface 60, and therefore an evaporation path for the residual liquid 90 is open between the pad 48 and the outside of the device 10.

The user then continues the rotational movement of the cap 16 relative to the container 12 in order to fully unscrew the cap 16 from the end piece 14. He or she then breaks the frangible parts of the ring 74. It will therefore be understood that this ring 74 makes it possible to simply check that the device has not been used previously.

It can be seen that the switch from the hermetic sealing configuration of the device 10 to the ventilation configuration is done transparently for the user who simply unscrews the cap 16 from the end piece 14.

He or she then presses on the container 12 and deforms it in order to deliver a droplet of liquid. Under the pressure exerted by the user, the valve 20 switches from the liquid blocking position to the liquid release position; a droplet is formed in the droplet forming means 50. When the droplet reaches a predetermined volume, it is released from the valve 20, for example to go into the eye of the user.

As soon as the user relaxes the pressure exerted on the container 12, the valve 20 reverts to its liquid blocking position. When the user wants to deliver an additional droplet, he or she once again deforms the container 12 until the droplet is delivered.

However, a small quantity of liquid may remain downstream of the valve 20, often in the droplet forming means 50.

Between two uses, the user rescrews the cap 16 onto the end piece 14. The locking means 64, 66, 84, 86 then prevent the displacement of the outer jacket 42 relative to the inner jacket 44. It will therefore be understood that it is possible to switch from the hermetic sealing configuration of the device 10 to the ventilation configuration, but the reverse is not possible. Thus, there is a guarantee that, once the device 10 has been used at least once, the evaporation path 90 for the residual liquid is always open. The locking means 64, 66, 84, 86 are therefore permanent and non-removable.

When the cap 16 is screw-mounted on the end piece 14, the expulsion shape 46 of the valve cooperates with the valve 20. Furthermore, this expulsion shape 46 comprises grooves 92 which delimit, with the valve 20, an evacuation pathway 52 for the residual liquid contained in the droplet forming means 50. This pathway 52 makes it possible to discharge the residual liquid to the pad 48, in which it is absorbed.

Then, the liquid absorbed by the pad 48 is evaporated out of the device 10 via the evaporation path 90 that is open between the pad 48 and the outside of the device 10.

There is therefore no residual liquid stagnating in the droplet forming means 50 and the formation of solid residue of the active principle that could result in the delivery of an overdose upon the delivery of a droplet or the delivery of solid particles in suspension in the droplet is avoided upon the next use of the device 10.

Other embodiments of the device will now be described in which the elements common to the different embodiments are identified by the same numeric references and for which the differences are expounded herein below.

FIG. 7 shows a second embodiment in which the outer jacket 42 comprises pins 94 forming the means for blocking the evaporation path 90 for the residual liquid absorbed by the pad 48.

In hermetic sealing configuration, the pins 94 cooperate with the air passage orifices 62 of the inner jacket 44, so that there is no possible communication between the pad 48 and the outside of the device 10.

In a way similar to what has been described in the preceding embodiment, when the user unscrews the cap 16 upon a first use of the device 10, he or she rotates the outer jacket 42 relative to the inner jacket 44. The abutments 86 travel over the ramps 68 and the rotational movement imparted by the user to the device 10 generates a longitudinal translational movement of the outer jacket 42 relative to the inner jacket 44. Upon this longitudinal movement of the two jackets 42, 44 relative to one another, the pins 94 no longer cooperate with the orifices 62 and the evaporation path 90 for the residual liquid is opened.

Just as in the first embodiment, once the device 10 is in ventilation configuration, the locking means do not allow the device to revert to the hermetic sealing configuration.

The third embodiment, shown in FIGS. 8 and 9, is similar to the first embodiment, apart from the location of the pad 48. In this embodiment, the pad 48 is not mounted on the inner jacket 44 of the cap 16 but is fixed onto the top jacket 26 of the dispensing end piece 14. The mode of operation of this device is similar to the mode of operation described previously.

The fourth embodiment, shown in FIGS. 10 and 11, comprises a dispensing end piece 14 similar to the end pieces previously described. It differs from the preceding embodiment in that the cap 16 comprises only a single jacket comprising air passage orifices 62. The rest of the device 10 conforms to what has been described previously.

Before first use, that is to say in hermetic sealing configuration, the device 10 comprises a removable cover 96 which blocks the air passage orifices 62 of the cap 16; it therefore blocks the evaporation path 90 for the residual liquid between the pad 48 and the outside of the device 10. Advantageously, this cover 96 also comprises a tongue 98 adhering to the cap 16 and to the support 18 of the end piece 14 so that it is not possible to unscrew the cap 16 of the device 10 without removing the cover 96 and thus opening the evaporation path 90 between the pad 48 and the outside of the device 10.

Figure 12:
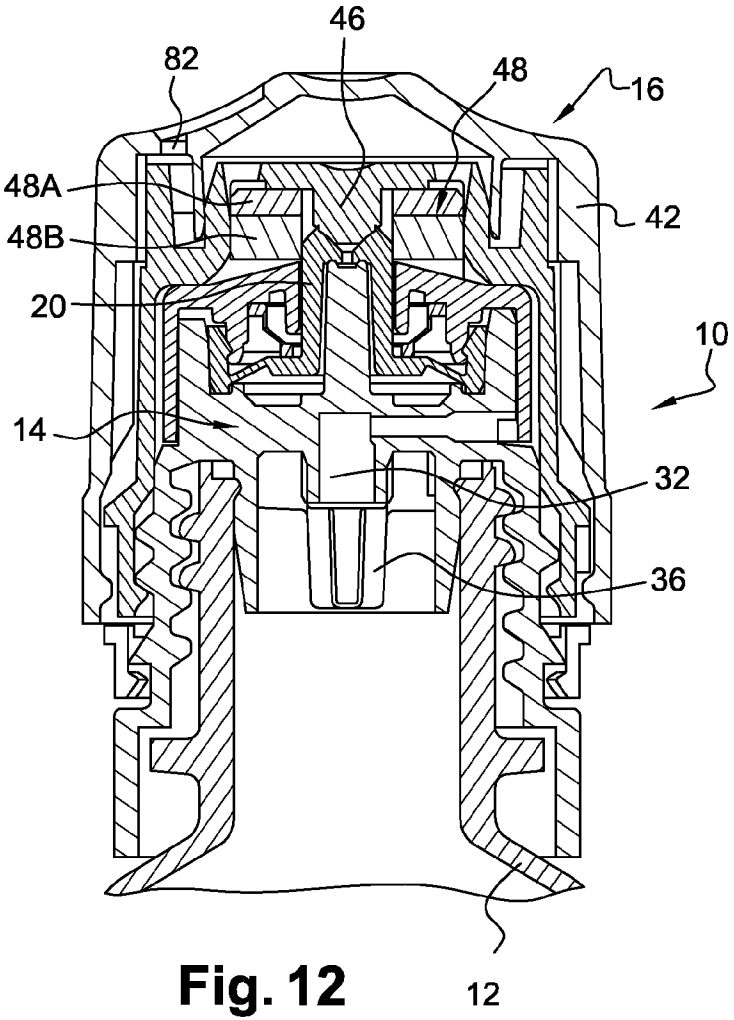
FIG. 12 is a cross-sectional view of a fifth embodiment of the device.

FIG. 12 shows a cross-sectional view of a fifth embodiment of the device 10, in which the pad 48 comprises two distinct absorbent materials 48A and 48B, the absorbent material 48A being more hydrophilic, therefore more absorbent, than the absorbent material 48B. In the embodiment of FIG. 12, the two distinct absorbent materials therefore have an axisymmetrical shape, in this case, a ring shape. The two rings 48A, 48B are arranged one on top of the other, in contact with one another, the ring of more hydrophilic material 48A being positioned downstream and the ring of less hydrophilic material 48B being positioned upstream in relation to the liquid dispensing direction. Thus, the liquid which is expelled by the expulsion shape 46 toward the pad 48 is preferentially absorbed by the most absorbent hydrophilic material 48A. Because of the contact between the two hydrophilic materials 48A, 48B, the liquid absorbed by the least hydrophilic material 48B is sucked in by the most hydrophilic material 48A. The residual liquid therefore does not stagnate or stagnates little in the least hydrophilic material 48B which is closest to the droplet forming means 50. The risk of a possible build-up of liquid in proximity to the droplet forming means 50 is therefore reduced.

In a particular embodiment, the least absorbent and therefore least hydrophilic material 48B may advantageously comprise a hydrophobic material. Thus, the material 48B is hydrophobic and absorbent and it allows the liquid situated upstream of the dispensing opening 22 to pass toward the most hydrophilic material 48A and do so, by virtue of the suction created by the material 48A that is the most hydrophilic and situated downstream of the least hydrophilic material relative to the droplet forming means 50. However, since the material 48B is hydrophobic, the liquid absorbed in the material 48B cannot return toward the dispensing opening 22. The dispensing opening 22 is therefore relatively dry. It will be understood that the porosity of the hydrophobic material 48B is such that it enables the liquid sucked in by the most hydrophilic material 48A to pass through the hydrophobic material 48B.

Advantageously, the most hydrophilic material 48A may comprise an antimicrobial agent, such as silver ions ($Ag^+$) and the least hydrophilic, even hydrophobic, material 48B may not include any antimicrobial agent. Thus, the liquid is sucked toward the most hydrophilic material 48A where antimicrobial agents prevent the development of bacteria. The risk that antimicrobial agents can be contained in the next droplet of liquid delivered by the device 10 is reduced because the antibacterial agent is not contained in the least hydrophilic material 48B which is closest to the droplet forming means 50.

Figure 13:
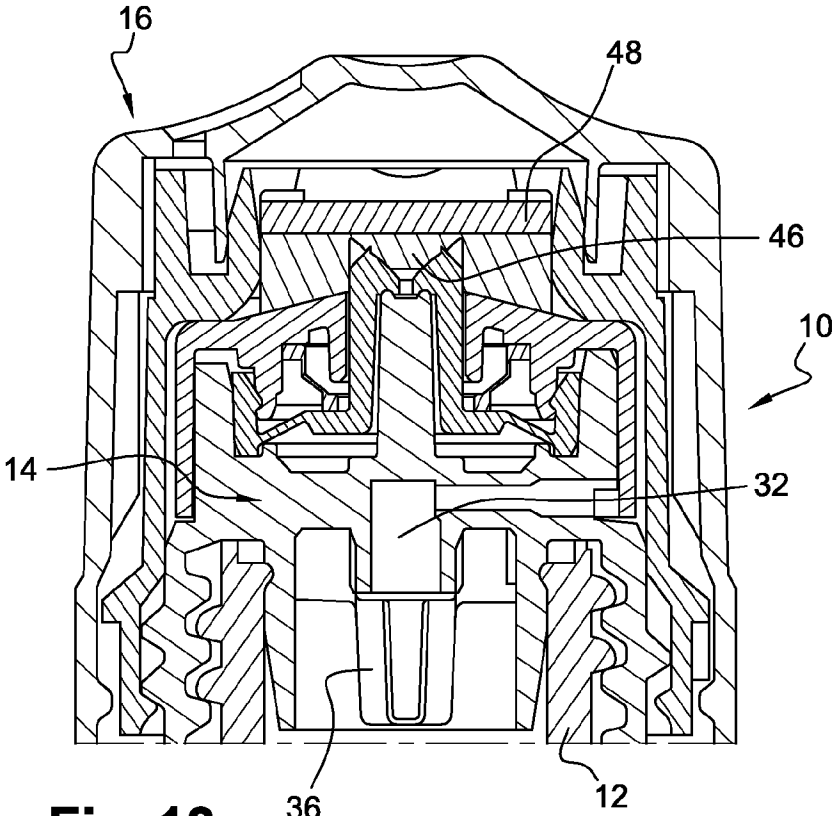
FIG. 13 is a cross-sectional view of a sixth embodiment of the device.

FIG. 13 shows a sixth embodiment of the device 10, in which the expulsion shape 46 is produced in absorbent material. The principle of operation of the device 10 is similar to the principle described in the fifth embodiment. In effect, the expulsion shape 46 comprises an absorbent material which is less hydrophilic than the hydrophilic material of the pad 48. Thus, the residual liquid located in the droplet forming means 50 after the dispensing of a liquid droplet is absorbed by the absorbent material of the expulsion shape 46 and is then sucked in by the hydrophilic material of the pad 48. The liquid is therefore drained toward the pad 48 through the absorbent material of the expulsion shape 46.

Just as in the fifth embodiment, the most hydrophilic material, that is to say the material of the pad 48, can comprise an antimicrobial agent, such as silver ions ($Ag^+$) and the least hydrophilic material, that is to say the material of the expulsion shape 46 situated downstream relative to the material of the pad 48, may not include any antimicrobial agent. Furthermore, the material of the expulsion shape may comprise a hydrophobic material. The hydrophobic material can, for example, be obtained by a surface treatment applied locally to the expulsion shape.

It will also be noted that, in the fifth and sixth embodiments, the device 10 does not comprise any jacket 38 for insulating the air diffusion member 36 from the liquid contained in the container 12. However, the device 10 could comprise such a jacket 38.

Figure 15:
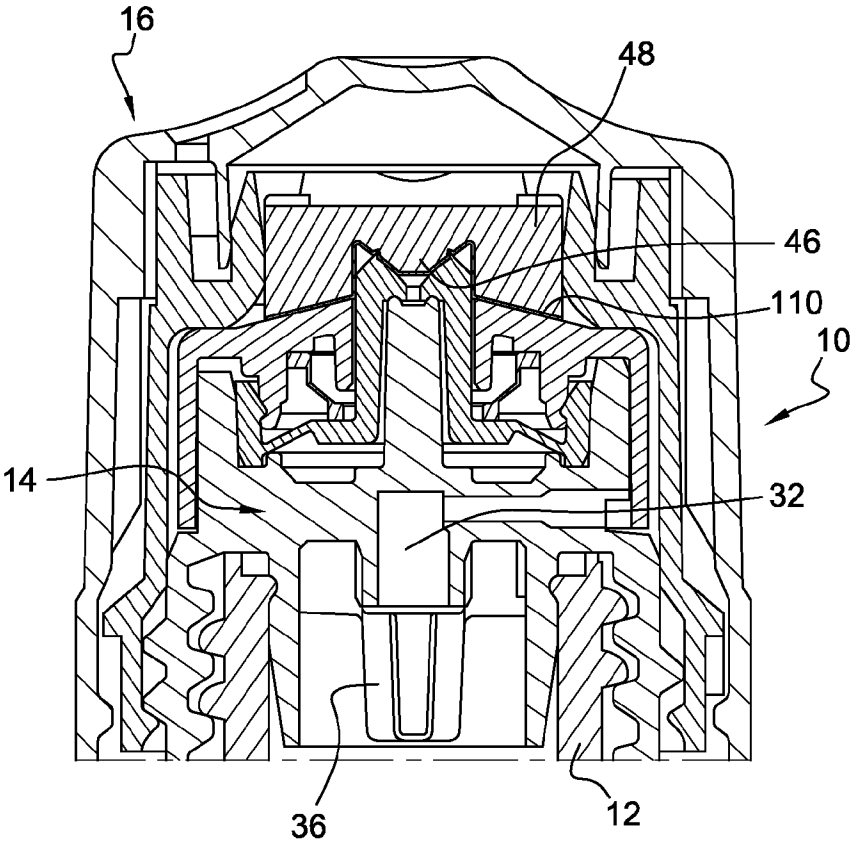
FIG. 15 is a cross-sectional view of an eighth embodiment of the device.

As a variant, as represented in FIG. 15, the device may comprise a pad 48 and an expulsion shape 46, both made of absorbent material, a hydrophobic veil 110 with open porosity being added onto the pad 48 and the expulsion shape 46. By virtue of this hydrophobic veil 110 with open porosity, the liquid present in the droplet forming means 50 is sucked through the veil by the expulsion shape 46 and, since the veil is hydrophobic, the liquid absorbed by the expulsion shape 46 and the pad 48 does not therefore return toward the dispensing opening 22. The veil 110 can, for example, be added by partial gluing or by partial welding of the veil onto the pad 48 and/or the expulsion shape 46.

Figure 14:
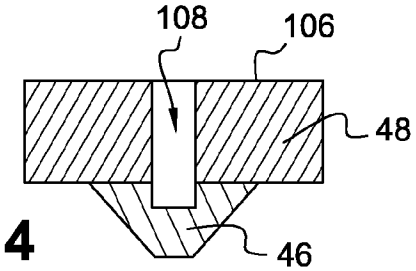
FIG. 14 is a cross-sectional view of a pad and of a liquid expulsion shape according to a seventh embodiment of the device.

FIG. 14 shows a pad 48 and an expulsion shape 46 according to a seventh embodiment of the device 10. In a manner similar to the sixth embodiment, the expulsion shape 46 is produced in absorbent material. However, in the seventh embodiment, the pad 48 comprises a contact surface 106 with the ambient air, the surface having at least one relief 108 in the form of a vertical and central recess of the pad 48, to increase the surface area of contact with the ambient air without modifying the overall dimensions of the pad. This relief 108 can also be present on the expulsion shape 46, as can be seen in FIG. 14.

Figure 16:
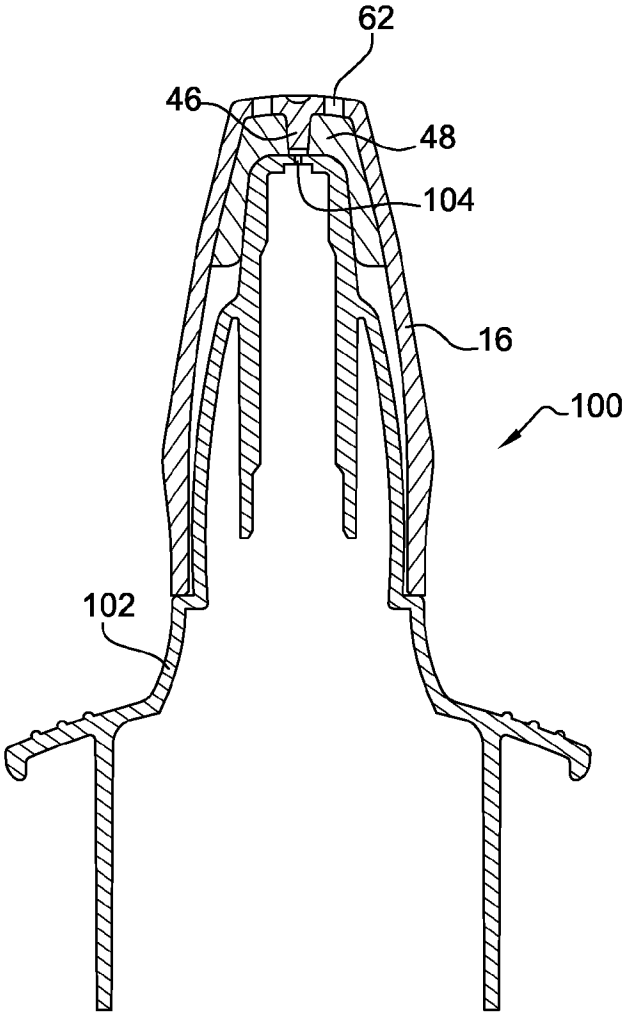
FIG. 16 is a cross-sectional view of a ninth embodiment of the device.

FIG. 16 shows a cross-sectional view of a ninth embodiment of the device. The device comprises an end piece 100 for dispensing liquid in spray form, intended to be mounted on a pump. This end piece 100 comprises a jacket 102 emerging at its downstream end on a liquid dispensing opening 104. In this example, the end piece 100 may comprise a dispensing valve, for example taking the form of a needle mounted to slide in the jacket 102 and blocking the opening 104 under the action of a spring.

The jacket 102 is covered by a cap 16 comprising an expulsion shape 46 for the residual liquid that may be located downstream of the dispensing opening 104. It can be seen that this expulsion shape 46 is situated in the immediate vicinity and facing the opening 104.

The cap also comprises air passage orifices 62 and, a pad 48, fixed onto the cap 16, more specifically inside the cap 16, around the expulsion shape 46.

In this embodiment, the hermetic sealing configuration of the device 100 can be obtained by the addition of a removable cover, preferably disposable, added to the cap 16.

The invention is not limited to the examples described above.

It will be understood in particular that the pad 48 can be fixed by ultrasound welding, by mechanical clamping or by any other appropriate means, that the cap 16 can take other configurations making it possible to associate a pad with a cap ensuring an expulsion of residual liquid or else making it possible to ensure a permanent evaporation configuration, and a hermetic sealing configuration for the storage of the device prior to its first use, or even that the return means of the valve 20 may comprise a helical spring.

Furthermore, the number of ramps, of abutments, of notches or of orifices and their arrangement are given solely by way of example and are not limiting.

Moreover, the first seven embodiments described in the figures relate to devices for dispensing liquid in droplet form and provided with a valve, in which the expulsion shape constitutes a shape for immobilizing the valve in a blocking position. It will be understood that it is possible to envisage devices for dispensing liquid in another form, for example in spray form, such as the device according to the eight embodiment, or even in jet form, with or without valve, or even without the immobilization of the valve, while retaining the possibility of draining the residual liquid out of the dispensing opening, by virtue of the presence of the absorption pad and of the expulsion shape situated in the vicinity of and facing the liquid dispensing opening.

The invention claimed is:

1. A liquid dispensing device, characterized in that it comprises:

a liquid dispensing opening, an absorption pad for absorbing residual liquid, arranged in proximity to the liquid dispensing opening, a removable cap comprising an expulsion shape, in the immediate vicinity of and facing the dispensing opening, configured to discharge the residual liquid toward the pad when the cap is fitted on the device, the expulsion shape having distal surfaces that complement an interior shape of liquid dispensing opening, and a path for the evaporation of the residual liquid between the pad and the outside of the device when the cap is fitted on the device, wherein the expulsion shape has one or more grooves creating an evacuation pathway for the residual liquid between the expulsion shape and the liquid dispensing opening.

2. A liquid dispensing device, characterized in that it comprises:

a liquid dispensing opening, an absorption pad for absorbing residual liquid, arranged in proximity to the liquid dispensing opening, a removable cap comprising an expulsion shape, in the immediate vicinity of and facing the dispensing opening, configured to discharge the residual liquid toward the pad when the cap is fitted on the device, and a path for the evaporation of the residual liquid between the pad and the outside of the device when the cap is fitted on the device, wherein the expulsion shape comprises an absorbent material.

3. The device according to claim 2, comprising a hydrophobic veil with open porosity, the veil being added onto the pad and the expulsion shape.

4. The device according to claim 3, wherein the pad comprises a hydrophilic material, this material being more hydrophilic than the absorbent material of the expulsion shape.

5. The device according to claim 2, wherein the expulsion shape comprises a hydrophobic material.

6. A liquid dispensing device, characterized in that it comprises:

a liquid dispensing opening, an absorption pad for absorbing residual liquid, arranged in proximity to the liquid dispensing opening, a removable cap comprising an expulsion shape, in the immediate vicinity of and facing the dispensing opening, configured to discharge the residual liquid toward the pad when the cap is fitted on the device, and a path for the evaporation of the residual liquid between the pad and the outside of the device when the cap is fitted on the device, wherein the expulsion shape is made in one piece with the pad and of the same material as the pad.

7. A liquid dispensing device, characterized in that it comprises:

a liquid dispensing opening, an absorption pad for absorbing residual liquid, arranged in proximity to the liquid dispensing opening, a removable cap comprising an expulsion shape, in the immediate vicinity of and facing the dispensing opening, configured to discharge the residual liquid toward the pad when the cap is fitted on the device, and a path for the evaporation of the residual liquid between the pad and the outside of the device when the cap is fitted on the device, wherein the pad comprises a surface for contact with the ambient air, the surface exhibiting at least one relief to increase the surface for contact with the ambient air.

8. A liquid dispensing device, characterized in that it comprises:

a liquid dispensing opening, an absorption pad for absorbing residual liquid, arranged in proximity to the liquid dispensing opening, a removable cap comprising an expulsion shape, in the immediate vicinity of and facing the dispensing opening, configured to discharge the residual liquid toward the pad when the cap is fitted on the device, and a path for the evaporation of the residual liquid between the pad and the outside of the device when the cap is fitted on the device, wherein the pad comprises at least two distinct absorbent materials, the at least two materials being arranged one on top of the other and the downstream material being more hydrophilic than the upstream material.

9. The device according to claim 8, wherein the upstream material comprises a hydrophobic material.

10. The device according to claim 1, for dispensing liquid in droplet form, comprising droplet forming means, the expulsion shape substantially complementing these droplet forming means.

11. The device according to claim 1, comprising a valve that can take a liquid releasing position and a liquid blocking position, the expulsion shape constituting a shape for immobilizing the valve in the liquid blocking position when the cap is fitted on the device.

12. The device according to claim 1, wherein the pad and/or the expulsion shape comprises an antimicrobial agent.

13. The device according to claim 4, wherein the most hydrophilic material comprises an antimicrobial agent and the least hydrophilic material is without any antimicrobial agent.

14. A liquid dispensing device, characterized in that it comprises:

a liquid dispensing opening, an absorption pad for absorbing residual liquid, arranged in proximity to the liquid dispensing opening, a removable cap comprising an expulsion shape, in the immediate vicinity of and facing the dispensing opening, configured to discharge the residual liquid toward the pad when the cap is fitted on the device, and a path for the evaporation of the residual liquid between the pad and the outside of the device when the cap is fitted on the device, wherein the device can take, when the cap is fitted on the device, a configuration of hermetic sealing of the device, prior to its first use, wherein the path for the evaporation of the residual liquid is blocked between the pad and the outside of the device, and a configuration of ventilation of the device, wherein the evaporation path is open between the pad and the outside.

15. The device according to claim 14, comprising means for locking the device in the ventilation configuration.

16. The device according to claim 14, wherein the cap comprises an outer jacket and an inner jacket, mounted to move relative to one another between a first configuration corresponding to the configuration of hermetic sealing of the device and a second configuration corresponding to the configuration of ventilation of the device.

17. The device according to claim 16, wherein the outer jacket and the inner jacket of the cap each comprise air passage orifices and the cap comprises means for blocking, when the device is in the hermetic sealing configuration, the evaporation path between the orifices of the outer jacket and those of the inner jacket.

18. The device according to claim 16, wherein the inner jacket comprises a ramp cooperating with a complementary abutment borne by the outer jacket, or, conversely, such that the rotation of the outer jacket relative to the inner jacket generates a longitudinal displacement of one relative to the other.

19. The device according to claim 14, wherein in configuration of hermetic sealing of the device, prior to its first use, the path for the evaporation of the residual liquid is blocked between the pad and the outside of the device by a removable cover added to the cap.

* * * * *